US007273265B2

(12) United States Patent
Koguchi et al.

(10) Patent No.: US 7,273,265 B2
(45) Date of Patent: Sep. 25, 2007

(54) INK JET RECORDING METHOD

(75) Inventors: Hideyuki Koguchi, Kanagawa (JP); Seiichi Inoue, Kangawa (JP)

(73) Assignee: Fujifilm Corporation, Tokyo (JP)

( * ) Notice: Subject to any disclaimer, the term of this patent is extended or adjusted under 35 U.S.C. 154(b) by 327 days.

(21) Appl. No.: 11/113,177

(22) Filed: Apr. 25, 2005

(65) Prior Publication Data

US 2005/0237373 A1 Oct. 27, 2005

(30) Foreign Application Priority Data

Apr. 26, 2004 (JP) ..... 2004-129699

(51) Int. Cl.
*B41J 2/06* (2006.01)

(52) U.S. Cl. ..... 347/55

(58) Field of Classification Search ..... 347/54–55
See application file for complete search history.

(56) References Cited

U.S. PATENT DOCUMENTS 4,314,263 A 2/1982 Carley
6,158,844 A 12/2000 Murakami et al.
7,118,196 B2 * 10/2006 Aoshima ..... 347/55
2005/0041067 A1 * 2/2005 Aoshima ..... 347/55
2005/0195244 A1 * 9/2005 Inoue ..... 347/55

FOREIGN PATENT DOCUMENTS

JP 10-138493 A 5/1998

* cited by examiner

*Primary Examiner*—Huan Tran
(74) *Attorney, Agent, or Firm*—Sughrue Mion, PLLC

(57) ABSTRACT

The ink jet recording method performs ink jet recording of an image on a recording medium using an ink jet head. The method allows an electrostatic force to act on ink prepared by dispersing charged particles containing colorants in a dispersion medium to form a thread of said ink, divides the thread into ink droplets of the ink to eject the ink droplets toward the recording medium and allows the ink droplets to be landed onto the recording medium moving relatively to the ink jet head to form an image dot on the recording medium. When a speed at which the recording medium and an ejection portion of the ink jet head for ejecting the ink droplets move relatively is referred to as "v", a division frequency of the thread is referred to as "f", and a diameter of the thread is referred to as "d", the following expression is satisfied:

$$(v/f)<(a\times d)$$

where "a" is a coefficient.

8 Claims, 4 Drawing Sheets

INK JET RECORDING METHOD

This application claims priority on Japanese patent application No. 2004-129699, the entire contents of which are hereby incorporated by reference.

BACKGROUND OF THE INVENTION

The present invention relates to an ink jet recording method in which ink droplets are ejected by causing an electrostatic force to act on ink obtained by dispersing charged particles containing a colorant in a dispersion medium.

In electrostatic ink jet recording, an ink composition (hereinafter referred to as "ink") obtained by dispersing charged fine particles containing a colorant (hereinafter referred to as "colorant particles") in a medium is used, and predetermined voltages are respectively applied to ejection portions of an ink jet head in accordance with image data, whereby the ink is ejected and controlled by utilizing electrostatic forces to record an image corresponding to the image data on a recording medium.

Known as an example of an electrostatic ink jet recording apparatus is an ink jet recording apparatus disclosed in JP 10-138493 A.

FIG. 4 is a schematic view showing an ink jet head of the electrostatic ink jet recording apparatus disclosed in JP 10-138493 A.

The ink jet head 80 includes a head substrate 82, ink guides 84, an insulating substrate 86, control electrodes 88, an electrode substrate 90, a D.C. bias voltage source 92, and a pulse voltage source 94.

Ejection ports (through holes) 96 through which ink is to be ejected are formed so as to extend perfectly through the insulating substrate 86. The head substrate 82 is provided so as to extend in a direction of disposition of the ejection ports 96, and the ink guides 84 are disposed in positions on the head substrate 82 corresponding to the ejection ports 96. Each ink guide 84 extends perfectly through the ejection port 96 so as for its tip portion 84*a* to project upwardly and beyond the surface of the insulating substrate 86 on an opposite side to the head substrate 82.

The head substrate 82 is disposed at a predetermined distance from the insulating substrate 86. Thus, a passage 98 for ink Q is defined between the head substrate 82 and the insulating substrate 86.

The ink Q containing fine particles (colorant particles) which are charged at the same polarity as that of a voltage applied to the control electrodes 88 is circulated through the ink passage 98 for example from the right-hand side to the left-hand side in FIG. 4, by a circulation mechanism for ink (not shown). Thus, the ink Q is supplied to the corresponding ones of the ejection ports 96.

The control electrode 88 is provided in a ring-like shape on the surface of the insulating substrate 86 on the side of the recording medium P so as to surround the ejection port 96. In addition, the control electrode 88 is connected to the pulse voltage source 94 for generating a pulse voltage in accordance with image data. The pulse voltage source 94 is grounded through the D.C. bias voltage source 92.

In the electrostatic ink jet recording, a recording medium P is preferably held on an insulating layer 91 of the grounded electrode substrate 90 with the recording medium P being charged to a high voltage opposite in polarity to that applied to the control electrode by a charging device utilizing a scorotron charger or the like.

In the electrostatic ink jet recording described above, when no voltage is applied to the control electrode 88, the Coulomb attraction between the bias voltage applied to the counter electrode and the electric charges of the colorant particles in the ink Q, the viscosity of the ink (dispersion medium), the surface tension, the repulsion among the charged particles, the fluid pressure when the ink is supplied, and the like operate in conjunction with one another. Thus, the balance is kept in a meniscus shape as shown in FIG. 4 in which the ink Q slightly rises from the ejection port (nozzle) 96.

In addition, the colorant particles migrate to move to the meniscus surface due to the Coulomb attraction or the like. In other words, the ink Q is concentrated on the meniscus surface.

When the voltage is applied to the control electrode 88 (ejection is valid), the bias voltage is superposed on the drive voltage so that the ink Q is attracted toward the side of the recording medium P (counter electrode) to form a nearly conical shape, i.e., a so-called Taylor cone.

When time elapses after the start of application of the voltage to the control electrode 88, the balance between the Coulomb attraction acting on the colorant particles and the surface tension of the dispersion medium is broken. As a result, there is formed a slender ink liquid column having a diameter of about several microns to several tens of microns which is called a thread. When time further elapses, as disclosed in U.S. Pat. No. 4,314,263 or the like, a tip portion of the thread is divided into small portions, and as a result, droplets of the ink Q are ejected to fly toward the recording medium P.

Hence, the division of the thread is caused at a frequency much higher than the drive frequency for the pulse voltage used to eject ink. That is, the division of the thread is continuously caused multiple times for a time period required to apply a pulse voltage to the corresponding ones of the control electrodes once. Consequently, an image of one dot is formed on the recording medium P with minute droplets which were separately ejected.

In the electrostatic ink jet recording, usually, a modulated pulse voltage is applied to the corresponding ones of the control electrodes 88 to turn ON/OFF the corresponding ones of the control electrodes 88 to modulate and eject ink droplets. Thus, the ink droplets are ejected on demand in accordance with an image to be recorded.

In such electrostatic ink jet recording, when ejection electrodes can be created so as to correspond to ejection portions, independent ink flow paths, partition walls, and the like for separating the ejection portions from each other may be omitted. In this case, a so-called nozzleless structure is obtained, so it becomes possible to achieve cost reduction of the ink jet head and the like and to improve yields. In addition, with the structure described above, even when a problem such as ink clogging has occurred in the ejection portions, it becomes possible to achieve recovery from the trouble through simple processing.

On the other hand, in the electrostatic ink jet recording, there is a problem in that the landing positions of ejected ink droplets are unstable due to division of a thread or the like, so dots formed by multiple droplets are also unstable and nonuniform and it is impossible to obtain an image having intended image quality with stability.

SUMMARY OF THE INVENTION

The present invention has been made in order to solve the problem described above and has an object to provide an ink jet recording method with which in electrostatic ink jet recording, it is possible to record a high-quality and high-resolution image with stability by enabling stabilization of the landing positions of the ink droplets and stabilization and adjustment of the diameter of dots on a recording medium.

In order to attain the object described above, the present invention provides an ink jet recording method in which ink jet recording of an image on a recording medium is performed in an ink jet head, comprising the steps of: allowing an electrostatic force to act on ink prepared by dispersing charged particles containing colorants in a dispersion medium to form a thread of the ink; dividing the thread into ink droplets of the ink to eject the ink droplets toward the recording medium; and allowing the ink droplets to be landed onto the recording medium moving relatively to the ink jet head to form an image dot on the recording medium, wherein, when a speed at which the recording medium and an ejection portion of the ink jet head for ejecting the ink droplets move relatively is referred to as "v", a division frequency of the thread is referred to as "f", and a diameter of the thread is referred to as "d", the following expression is satisfied:

$$(v/f)<(a\times d)$$

where "a" is a coefficient determined by a density, a surface tension and a viscosity of the ink, as well as a flying droplet diameter and a flying speed of each of the ink droplets of the ink. The ink jet recording method comprising: forming a thread of ink prepared by dispersing charged particles containing colorants in a dispersion medium by allowing an electrostatic force to act on the ink; ejecting ink droplets of the ink toward the recording medium by dividing the thread into the ink droplets; and forming an image dot on the recording medium by allowing the ink droplets of the ink to land onto the recording medium moving relatively to the ink jet head.

Here, it is preferable that the coefficient "a" is in a range of 1.1 to 15.

Also, it is preferable that at least one of a condition that the diameter of the thread is 10 μm or less and a condition that a diameter of each of the ejected ink droplets is 20 μm or less is satisfied.

Further, it is preferable that a division frequency of the thread is higher than an image recording frequency controlling ejection of the ink droplets.

Still further, it is preferable that the division frequency of the thread is 10 or more times as high as the image recording frequency controlling the ejection of the ink droplets.

Also, it is preferable that one image dot is formed by ejecting, before fixing a previous ink droplet landed on the recording medium, the following ink droplet so as to be landed on the recording medium in an overlapping manner. Therefore, one image dot is formed by ejecting multiple droplets so as to be landed on the recording medium in an overlapping manner and then fixing the ink droplets onto the recording medium.

Also, it is preferable that the number of ink droplets forming one image dot is controlled in accordance with the image to be recorded.

Also, it is preferable that one image dot is formed by causing five or more ink droplets to be landed on the recording medium in an overlapping manner.

According to the present invention having the construction described above, in electrostatic ink jet recording, the landing positions of ink droplets on a recording medium are stabilized, so it becomes possible to suitably form one image dot with ejected multiple droplets, which enables stabilization and adjustment of diameters of dots on the recording medium and image recording where dots formed have intended diameters. As a result, it becomes possible to record a high-quality and high-resolution image with stability.

In addition, according to the present invention, it also becomes possible to perform density control and dot diameter control through pulse width modulation as necessary. As a result, it also becomes possible to form a high-quality and high-resolution image having higher gradation resolving power and higher density stability.

DETAILED DESCRIPTION OF THE INVENTION

Figure 1A:
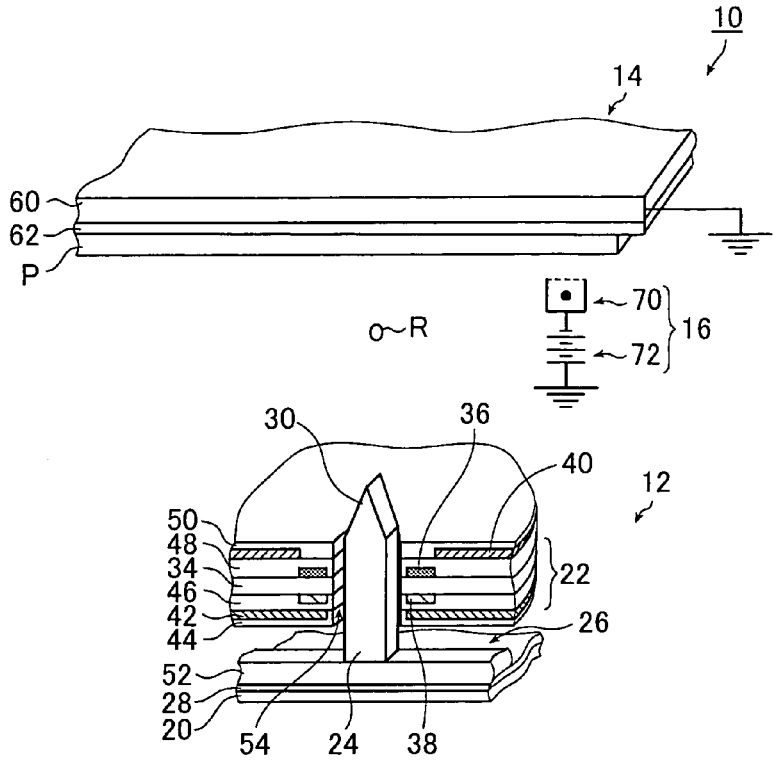
FIGS. 1A and 1B are conceptual views of an example of an ink jet recording apparatus for implementing an ink jet recording method of the present invention.

An ink jet recording method of the present invention will hereinafter be described in detail on the basis of a preferred embodiment shown in the accompanying drawings.

The ink jet recording method of the present invention is based on electrostatic ink jet recording in which an electrostatic force is caused to act on ink obtained by dispersing charged particles containing colorants (hereinafter referred to as colorant particles) in a carrier liquid (dispersion medium).

The carrier liquid used in the ink is preferably a dielectric liquid (non-aqueous solvent) having a high electrical resistivity (equal to or larger than $10^9$ Ω·cm, and more preferably equal to or larger than $10^{10}$ Ω·cm). If the electrical resistivity of the carrier liquid is low, the concentration of the colorant particles does not occur since the carrier liquid receives the injection of the electric charges and is charged due to a drive voltage applied to the control electrodes. In addition, since there is also anxiety that the carrier liquid having a low electrical resistivity causes the electrical conduction between the adjacent control portions, the carrier liquid having a low electrical resistivity is unsuitable for the present invention.

The relative permittivity of the dielectric liquid used as the carrier liquid is preferably equal to or smaller than 5, more preferably equal to or smaller than 4, and much more preferably equal to or smaller than 3.5. Such a range is selected for the relative permittivity, whereby the electric field effectively acts on the colorant particles contained in the carrier liquid to facilitate the electrophoresis of the colorant particles.

Note that the upper limit of the specific electrical resistance of the carrier liquid is desirably about $10^{16}$ Ω·cm, and the lower limit of the relative permittivity is desirably about 1.9. The reason why the electrical resistance of the carrier liquid preferably falls within the above-mentioned range is that if the electrical resistance becomes low, then the ejection of the ink droplets under a low electric field becomes worse. Also, the reason why the relative permittivity preferably falls within the above-mentioned range is that if the relative permittivity becomes high, then the electric field is relaxed due to the polarization of the solvent, and as a result the color of dots formed under this condition becomes light, or the bleeding occurs.

Preferred examples of the dielectric liquid used as the carrier liquid include straight-chain or branched aliphatic hydrocarbons, alicyclic hydrocarbons, aromatic hydrocarbons, and the same hydrocarbons substituted with halogens. Specific examples thereof include hexane, heptane, octane, isooctane, decane, isodecane, decalin, nonane, dodecane, isododecane, cyclohexane, cyclooctane, cyclodecane, benzene, toluene, xylene, mesitylene, Isopar C, Isopar E, Isopar G, Isopar H, Isopar L, Isopar M (Isopar: a trade name of EXXON Corporation), Shellsol 70, Shellsol 71 (Shellsol: a trade name of Shell Oil Company), AMSCO OMS, AMSCO 460 Solvent, (AMSCO: a trade name of Spirits Co., Ltd.), a silicone oil (such as KF-96L, available from Shin-Etsu Chemical Co., Ltd.). The dielectric liquid may be used singly or as a mixture of two or more thereof.

For such colorant particles dispersed in the carrier liquid, colorants themselves may be dispersed as the colorant particles into the carrier liquid, but dispersion resin particles are preferably contained for enhancement of fixing property. In the case where the dispersion resin particles are contained in the carrier liquid, in general, there is adopted a method in which pigments are covered with the resin material of the dispersion resin particles to obtain particles covered with the resin, or the dispersion resin particles are colored with dyes to obtain the colored particles.

As the colorants, pigments and dyes conventionally used in ink compositions for ink jet recording, (oily) ink compositions for printing, or liquid developers for electrostatic photography may be used.

Pigments used as colorants may be inorganic pigments or organic pigments commonly employed in the field of printing technology. Specific examples thereof include but are not particularly limited to known pigments such as carbon black, cadmium red, molybdenum red, chrome yellow, cadmium yellow, titanium yellow, chromium oxide, viridian, cobalt green, ultramarine blue, Prussian blue, cobalt blue, azo pigments, phthalocyanine pigments, quinacridone pigments, isoindolinone pigments, dioxazine pigments, threne pigments, perylene pigments, perinone pigments, thioindigo pigments, quinophthalone pigments, and metal complex pigments.

Preferred examples of dyes used as colorants include oil-soluble dyes such as azo dyes, metal complex salt dyes, naphthol dyes, anthraquinone dyes, indigo dyes, carbonium dyes, quinoneimine dyes, xanthene dyes, aniline dyes, quinoline dyes, nitro dyes, nitroso dyes, benzoquinone dyes, naphthoquinone dyes, phthalocyanine dyes, and metal phthalocyanine dyes.

Further, examples of dispersion resin particles include rosins, rosin-modified phenol resin, alkyd resin, a (meta) acryl polymer, polyurethane, polyester, polyamide, polyethylene, polybutadiene, polystyrene, polyvinyl acetate, acetal-modified polyvinyl alcohol, and polycarbonate.

Of those, from the viewpoint of ease for particle formation, a polymer having a weight average molecular weight in a range of 2,000 to 1,000,000 and a polydispersity (weight average molecular weight/number average molecular weight) in a range of 1.0 to 5.0 is preferred. Moreover, from the viewpoint of ease for the fixation, a polymer in which one of a softening point, a glass transition point, and a melting point is in a range of 40° C. to 120° C. is preferred.

In ink Q, the content of colorant particles (total content of colorant particles and dispersion resin particles) preferably falls within a range of 0.5 to 30.0 wt % for the overall ink, more preferably falls within a range of 1.5 to 25.0 wt %, and much more preferably falls within a range of 3.0 to 20.0 wt %. If the content of colorant particles decreases, the following problems become easy to arise. The density of the printed image is insufficient, the affinity between the ink Q and the surface of a recording medium P becomes difficult to obtain to prevent the image firmly stuck to the surface of the recording medium P from being obtained, and so forth. On the other hand, if the content of colorant particles increases, problems occur in that the uniform dispersion liquid becomes difficult to obtain, the clogging of the ink Q is easy to occur in an ink jet head 12 or the like to make it difficult to obtain the stable ink ejection, and so forth.

In addition, the average particle diameter of the colorant particles dispersed in the carrier liquid preferably falls within a range of 0.1 to 5.0 μm, more preferably falls within a range of 0.2 to 1.5 μm, and much more preferably falls within a range of 0.4 to 1.0 μm. Those particle diameters are measured with CAPA-500 (a trade name of a measuring apparatus manufactured by HORIBA LTD.).

After the colorant particles are dispersed in the carrier liquid, a charging control agent is added to the resultant carrier liquid to charge the colorant particles, and the charged colorant particles are dispersed in the resultant liquid to thereby produce the ink Q. Note that in dispersing the colorant particles in the carrier liquid, a dispersing agent may be added if necessary.

As the charging control agent, for example, various ones used in the electrophotographic liquid developer can be utilized. In addition, it is also possible to utilize various charging control agents described in "DEVELOPMENT AND PRACTICAL APPLICATION OF RECENT ELECTRONIC PHOTOGRAPH DEVELOPING SYSTEM AND TONER MATERIALS", pp. 139 to 148; "ELECTROPHOTOGRAPHY-BASES AND APPLICATIONS", edited by THE IMAGING SOCIETY OF JAPAN, and published by CORONA PUBLISHING CO. LTD., pp. 497 to 505, 1988; and "ELECTRONIC PHOTOGRAPHY" by Yuji Harasaki, 16 (No. 2), p. 44, 1977.

Note that the colorant particles may be positively or negatively charged as long as the charged colorant particles are identical in polarity to the drive voltages applied to control electrodes.

In addition, the charging amount of colorant particles is preferably in a range of 5 to 200 μC/g, more preferably in a range of 10 to 150 μC/g, and much more preferably in a range of 15 to 100 μC/g.

In addition, the electrical resistance of the dielectric liquid may be changed by adding the charging control agent in some cases. Thus, the distribution factor P defined below is preferably equal to or larger than 50%, more preferably equal to or larger than 60%, and much more preferably equal to or larger than 70%.

$$P=100\times(\sigma 1-\sigma 2)/\sigma 1$$

where $\sigma 1$ is an electric conductivity of the ink Q, and $\sigma 2$ is an electric conductivity of a supernatant liquid which is obtained by inspecting the ink Q with a centrifugal separator. Those electric conductivities were obtained by measuring the electric conductivities of the ink Q and the supernatant liquid under a condition of an applied voltage of 5 V and a frequency of 1 kHz using an LCR meter of an AG-4311 type (manufactured by ANDO ELECTRIC CO., LTD.) and electrode for liquid of an LP-05 type (manufactured by KAWAGUCHI ELECTRIC WORKS, CO., LTD.). In addition, the centrifugation was carried out for 30 minutes under a condition of a rotational speed of 14,500 rpm and a temperature of 23° C. using a miniature high speed cooling centrifugal machine of an SRX-201 type (manufactured by TOMY SEIKO CO., LTD.).

The ink Q as described above is used, which results in that the colorant particles are likely to migrate and hence the colorant particles are easily concentrated.

The electric conductivity of the ink Q is preferably in a range of 100 to 3,000 pS/cm, more preferably in a range of 150 to 2,500 pS/cm, and much more preferably in a range of 200 to 2,000 pS/cm. The range of the electric conductivity as described above is set, resulting in that the applied voltages to the ejection electrodes are not excessively high, and also there is no anxiety to cause the electrical conduction between the adjacent ejection electrodes.

In addition, the surface tension of the ink Q is preferably in a range of 15 to 50 mN/m, more preferably in a range of 15.5 to 45.0 mN/m, and much more preferably in a range of 16 to 40 mN/m. The surface tension is set in this range, resulting in that the applied voltages to the ejection electrodes are not excessively high, and also the ink does not leak or spread to the periphery of the head to contaminate the head.

Moreover, the viscosity of the ink Q is preferably in a range of 0.5 to 5.0 mPa·sec, more preferably in a range of 0.6 to 3.0 mPa·sec, and much more preferably in a range of 0.7 to 2.0 mPa·sec.

The ink Q can be prepared for example by dispersing colorant particles into a carrier liquid to form particles and adding a charging control agent to the dispersion medium (dispersion solvent) to allow the colorant particles to be charged. The following methods are given as the specific methods.

(1) A method including: previously mixing (kneading) a colorant and/or dispersion resin particles; dispersing the resultant mixture into a carrier liquid using a dispersing agent when necessary; and adding the charging control agent thereto.

(2) A method including: adding a colorant and/or dispersion resin particles and a dispersing agent into a carrier liquid at the same time for dispersion; and adding the charging control agent thereto.

(3) A method including adding a colorant and the charging control agent and/or the dispersion resin particles and the dispersing agent into a carrier liquid at the same time for dispersion.

As described above, the ink jet recording method of the present invention is directed to electrostatic ink jet recording in which an electrostatic force is caused to act on ink obtained by dispersing colorant particles in a carrier liquid to thereby eject ink droplets R (liquid droplets).

Figure 1B:
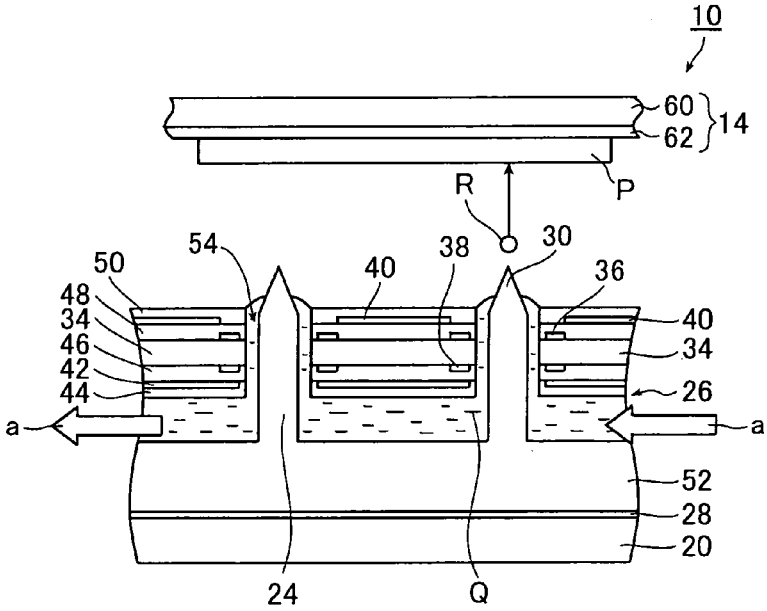

FIGS. 1A and 1B show conceptually an example of an electrostatic ink jet recording apparatus for implementing the ink jet recording method of the present invention. FIG. 1A is a (partial cross-sectional) perspective view, and FIG. 1B is a partial cross-sectional view.

An ink jet recording apparatus (hereinafter, referred to as a recording apparatus) 10 shown in FIGS. 1A and 1B includes the ink jet head (hereinafter referred to as the head) 12, holding means 14 of the recording medium P, and a charging unit 16. In the recording apparatus 10, after the recording medium P is charged to a bias electric potential by the charging unit 16, the head 12 and the holding means 14 are moved relatively under the condition that the head 12 is opposed to the recording medium P, and each ejection portion of the head 12 is driven by modulation in accordance with an image to be recorded to eject ink droplets R on demand, whereby an intended image is recorded on the recording medium P.

The head 12 is an electrostatic ink jet head for allowing an electrostatic force to act on the ink Q thereby ejecting ink droplets R. The head 12 includes a head substrate 20, an ejection port substrate 22 and ink guides 24.

Furthermore, the head substrate 20 and the ejection port substrate 22 are opposed to each other at a predetermined distance, and an ink flow path 26 for supplying the ink Q to each ejection port is formed therebetween. The ink Q contains colorant particles charged in the same polarity as that of a control voltage to be applied to first ejection electrodes 36 and second ejection electrodes 38. During recording, the ink Q is circulated in the ink flow path 26 at a predetermined speed (e.g., ink flow of 200 mm/s) in a predetermined direction.

The head substrate 20 is a sheet-shaped insulating substrate common to all the ejection portions, and a floating conductive plate 28 in an electrically floating state is provided on the surface of the head substrate 20.

In the floating conductive plate 28, an induced voltage induced in accordance with a voltage value of the control voltage to be applied to the control electrodes of the ejection portions (described later) is generated during recording of an image. Furthermore, a voltage value of the induced voltage automatically varies in accordance with the number of operation channels. Owing to the induced voltage, the colorant particles in the ink Q flowing in the ink flow path 26 are urged to migrate to the ejection port substrate 22 side. That is, ink in ejection ports 54 (described later) is concentrated more appropriately.

The floating conductive plate 28 is not an indispensable component but is preferably provided as appropriate. Furthermore, the floating conductive plate 28 should be disposed on the head substrate 20 side of the ink flow path 26, and for example, may be disposed in the head substrate 20. Further, it is preferable that the floating conductive plate 28 be disposed on an upstream side of the ink flow path 26 with respect to the position where the ejection portions are placed. Furthermore, a predetermined voltage may be applied to the floating conductive plate 28.

On the other hand, the ejection port substrate 22 is a sheet-shaped insulating substrate common to all the ejection portions like the head substrate 20. The ejection port substrate 22 includes an insulating substrate 34, the first ejection electrodes 36, the second ejection electrodes 38, a guard electrode 40, a shielding electrode 42 and insulating layers 44, 46, 48 and 50. Furthermore, the ejection ports 54 for the ink Q are formed in the ejection port substrate 22 at positions corresponding to the respective ink guides 24.

As described above, the ejection port substrate 22 is placed at a distance from the head substrate 20, and the ink flow path 26 is formed therebetween.

The first ejection electrodes 36 and the second ejection electrodes 38 are circular electrodes provided in a ring shape on the upper surface and the lower surface of the insulating substrate 34 so as to surround the ejection ports 54 corresponding to the respective ejection portions. The upper surfaces of the insulating substrate 34 and the first ejection electrodes 36 are covered with the insulating layer 48 for protecting and flattening the surfaces, and similarly, the lower surfaces of the insulating substrate 34 and the second ejection electrodes 38 are covered with the insulating layer 46 for flattening the surfaces.

The first ejection electrodes 36 and the second ejection electrodes 38 are not limited to the circular electrodes in a ring shape. As long as they are disposed so as to be adjacent to the ink guides 24, electrodes in any shape such as substantially circular electrodes, divided circular electrodes, parallel electrodes, and substantially parallel electrodes can be used.

Figure 2A:
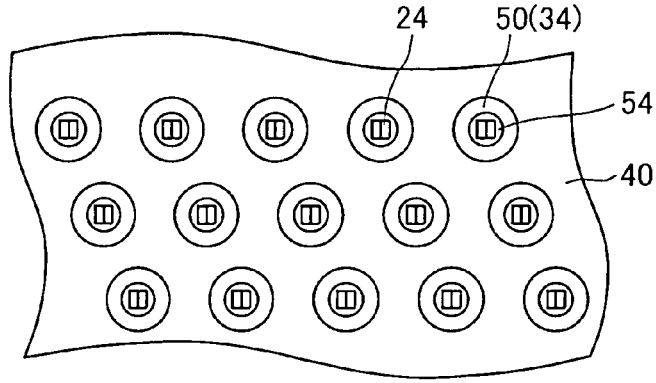
FIGS. 2A to 2D are conceptual views illustrating ejection electrodes of the ink jet recording apparatus shown in FIGS. 1A and 1B.

As shown in FIG. 2A, in the head 12, the respective ejection portions composed of the ink guides 24, the first ejection electrodes 36, the second ejection electrodes 38, the ejection ports 54, and the like are arranged two-dimensionally in a matrix.

Figure 2B:
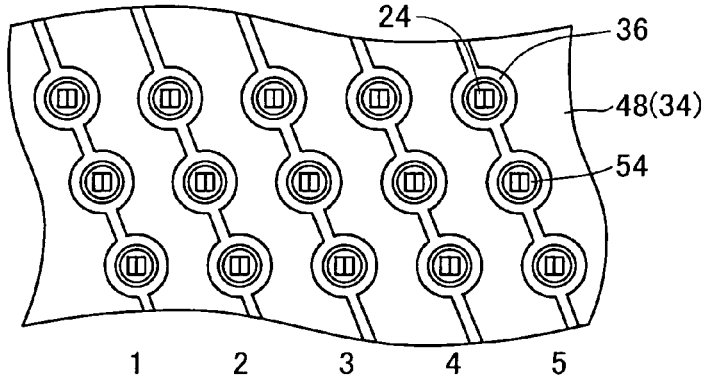

As shown in FIG. 2B, the head 12 has ejection portions arranged in 3 rows (A-row, B-row, C-row) in a column direction (main scanning direction). FIGS. 2A to 2D show that 15 ejection portions are arranged in a matrix in 3 rows (A-row, B-row, C-row) in a column direction (main scanning direction) and 5 columns (1-column, 2-column, 3-column, 4-column, 5-column) in a row direction (sub-scanning direction).

Figure 2C:
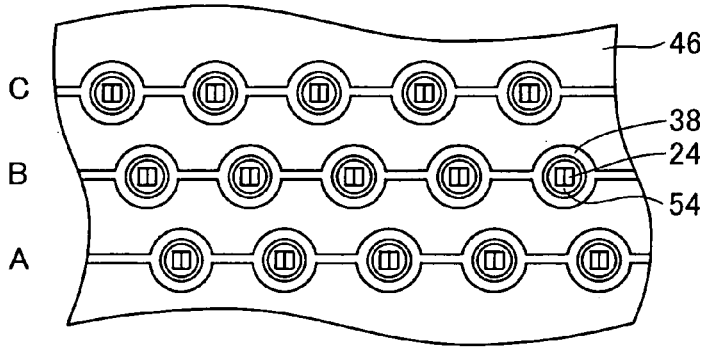

As shown in FIG. 2B, the first ejection electrodes 36 of the ejection portions arranged in the same column are connected to each other. Furthermore, as shown in FIG. 2C, the second ejection electrodes 38 of the ejection portions arranged in the same row are connected to each other.

Furthermore, although not shown, the first ejection electrodes 36 and the second ejection electrodes 38 are respectively connected to the pulse power sources for outputting a pulse voltage for ejecting the ink droplets R (driving each electrode).

The ejection portions in each row are arranged at predetermined intervals in the row direction.

Furthermore, the ejection portions in the B-row are arranged at a predetermined distance in the column direction from the ejection portions in the A-row, and positioned between the ejection portions in the A-row and the ejection portions in the C-row in the row direction. Similarly, the ejection portions in the C-row are arranged at a predetermined distance in the column direction from 5 ejection portions in the B-row, and positioned in the row direction between the ejection portions in the B-row and the ejection portions in the A-row.

Thus, by placing the ejection portions included in the respective rows A, B, and C so that they are shifted in the row direction, one row for recording on the recording medium P is divided into three groups in the row direction.

During recording of an image, the first ejection electrodes 36 disposed in the same column are driven simultaneously at the same voltage level. Similarly, five second ejection electrodes 38 disposed in the same row are driven simultaneously at the same voltage level.

Furthermore, one row for recording on the recording medium P is divided in the row direction into three groups corresponding to the number of rows of the second ejection electrodes 38, whereby sequential driving in time division is performed. For example, in the case shown in FIGS. 2A to 2D, by sequentially recording in the A-row, the B-row, and the C-row of the second ejection electrodes 38 at a predetermined timing, one row of an image can be recorded on the recording medium P. Furthermore, in synchronization with this, the first ejection electrodes 36 are driven by pulse modulation in accordance with image data (image to be recorded), and the ejection of the ink droplets R is turned ON/OFF, whereby an image is recorded.

Thus, in the illustrated example, an image is recorded while the recording medium P and the head 12 are moved relatively in the column direction (main scanning direction), whereby an image can be recorded at a recording density that is three times as high as that of each row in the row direction (sub-scanning direction).

The control electrodes are not limited to a two-layered electrode structure composed of the first ejection electrodes 36 and the second ejection electrodes 38. They may have a single-layered electrode structure or a three or more layered electrode structure.

The guard electrode 40 is a sheet-shaped electrode common to all the ejection portions. As shown in FIG. 2A, portions corresponding to the first ejection electrodes 36 and the second ejection electrodes 38 formed on the circumferences of the ejection ports 54 of the respective ejection portions are opened in a ring shape. Furthermore, the upper surfaces of the insulating layer 48 and the guard electrode 40 are covered with the insulating layer 50 for protecting and flattening the surfaces. A predetermined voltage is applied to the guard electrode 40, which plays a role of suppressing the interference of an electric field generated between the ink guides 24 of the adjacent ejection portions.

Figure 2D:
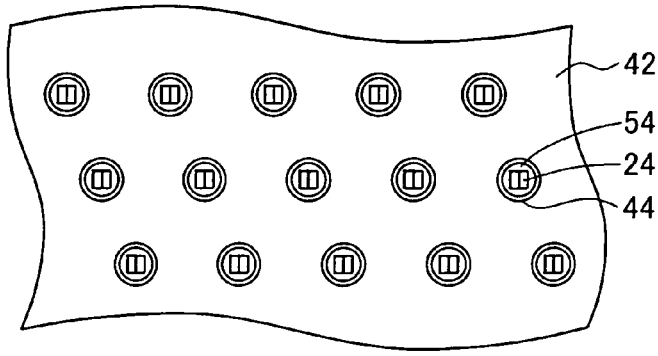

The shield electrode 42 provided on the ink flow path 26 side of the insulating layer 46 is also a sheet-shaped electrode common to all the ejection portions. As shown in FIG. 2D, the shield electrode 42 extends to the portions corresponding to the inside diameters of the first ejection electrodes 36 and the second ejection electrodes 38 formed on the circumferences of the ejection ports 54 of the respective ejection portions. The surface of the shield electrode 42 on the ink flow path 26 side is coated with the insulating layer 44 which protects and flattens the surface of the shield electrode 42. The shield electrode 42 blocks a repulsion electric field from the first ejection electrodes 36 or the second ejection electrodes 38 to the ink flow path 26.

The guard electrode 40 and the shield electrode 42 are preferably disposed, although they are not essential components.

The ink guide 24 is a flat plate made of ceramic with a predetermined thickness having a convex tip end portion 30. In the illustrated example, the ink guides 24 of the ejection portions in the same row are arranged at predetermined intervals on the same support 52 placed on the floating conductive plate 28 on the head substrate 20. The ink guides 24 pass through the ejection ports 54 formed in the ejection port substrate 22 so that the tip end portions 30 protrude upward from an outermost surface (upper surface of the insulating layer 50 in FIG. 1A) on the recording medium P side of the ejection port substrate 22.

The tip end portions 30 of the ink guides 24 are molded in a substantially triangular shape (or a trapezoidal shape) that is tapered gradually toward the holding means 14 of the recording medium P.

It is preferable that a metal be vapor-deposited onto the tip end portions (endmost portions) 30. Although the vapor deposition of the metal onto the tip end portions 30 is not an indispensable element, it substantially increases the dielectric constants of the tip end portions 30, and makes it easy to generate a strong electric field.

There is no particular limit to the shapes of the ink guides 24, as long as the colorant particles in the ink Q are allowed to migrate toward the tip end portions 30 (that is, the ink Q is concentrated). For example, the tip end portions 30 may be varied to an arbitrary shape (e.g., it may not be convex). Furthermore, in order to promote the concentration of ink, slits serving as ink guide grooves for guiding the ink Q to the tip end portions 30 by virtue of a capillary phenomenon may be formed in the central portions of the ink guides 24 in the top-bottom direction on the paper plane of FIG. 1A.

The holding means 14 of the recording medium P has an electrode substrate 60 and an insulating sheet 62, and is placed at a predetermined distance (e.g., 200 to 1000 μm) from the tip end portions 30 of the ink guides 24 so as to be opposed to the head 12.

The electrode substrate 60 is grounded, and the insulating sheet 62 is placed on the surface of the electrode substrate 60 on the ink guide 24 side. During recording, the recording medium P is held on the surface of the insulating sheet 62, that is, the holding means 14 (insulating sheet 62) functions as a platen for the recording medium P.

The charging unit 16 includes a scorotron charger 70 for charging the recording medium P to a negative high voltage and a bias voltage source 72 for supplying a negative high voltage to the scorotron charger 70.

The scorotron charger 70 is placed at a predetermined distance from the recording medium P so as to be opposed to the surface of the recording medium P. Furthermore, the terminal on a negative side of the bias voltage source 72 is connected to the scorotron charger 70, and the terminal on a positive side thereof is grounded.

The charging means of the charging unit 16 is not limited to the scorotron charger 70, and various kinds of known charging means such as a corotron charger and a solid-state charger can be used.

During recording of an image, the surface of the insulating sheet 62 or the recording medium P is charged to a predetermined negative high voltage (e.g., −1,500 V) opposite in polarity to that of a high voltage to be applied to the first ejection electrodes 36 and the second ejection electrodes 38. Consequently, the recording medium P is biased to a negative high voltage with respect to the first ejection electrodes 36 or the second ejection electrodes 38, and is electrostatically attracted to the insulating sheet 62 of the holding means 14.

More specifically, in the illustrated recording apparatus 10, the recording medium P functions as a counter electrode in electrostatic ink jet recording.

In this embodiment, the holding means 14 is composed of the electrode substrate 60 and the insulating sheet 62, and the recording medium P is charged to a negative high voltage by the charging unit 16 to allow the recording medium P to be electrostatically attracted to the surface of the insulating sheet 62. However, the present invention is not limited thereto. The holding means 14 may be composed only of the electrode substrate 60, and the holding means 14 (electrode substrate 60) may be connected to the bias power source 72 to be always biased to a negative high voltage, whereby the recording medium P is electrostatically attracted to the surface of the electrode substrate 60.

Furthermore, the electrostatic attraction of the recording medium P to the holding means 14, and the application of a negative high bias voltage to the recording medium P or the application of a negative high bias voltage to the holding means 14 may be performed with separate negative high voltage sources, and the method of supporting the recording medium P by the holding means 14 is not limited to the electrostatic attraction of the recording medium P, and other supporting methods and supporting means may be used.

The head 12 as described above is a line head having in the row direction a line of the ejection portions corresponding to the width of a side of the recording medium P of the maximum size. The recording medium P held by the holding means 14 is transported for main scanning in the column direction perpendicular to the row direction and the entire surface of the recording medium P is scanned by the ejection portions, whereby the ink droplets R adhere to the recording medium P to record an image thereon.

As a means for transporting the recording medium P, the insulating sheet 62 to which the recording medium P is electrostatically attracted is transported in the main scanning direction to thereby transport the recording medium P. Since image recording is performed in this embodiment by transporting the recording medium P in the main scanning direction while the ink jet head 12 is fixed, the speed at which the recording medium P is transported is a relative moving speed, which will be described later in detail.

The above process is not the sole method for transporting the recording medium and any conventionally known transport means can be used.

The ink jet recording method of the present invention is not limited to the method using the line head described above. Ink jet recording using a so-called shuttle type head may be adopted in which the recording medium P is intermittently transported and the head is scanned in synchronization with this transport in a direction perpendicular to the direction in which the recording medium P is transported.

The head 12 in the illustrated example has the first and second ejection electrodes 36 and 38. When the pulse voltages are applied to both the first and second ejection electrodes 36 and 38, respectively (both the first and second ejection electrodes 36 and 38 are driven), the ink droplets R are ejected.

As described above, the second ejection electrodes 38 are sequentially set at a high voltage level (e.g., at 400 to 600 V) or in a high impedance state (in an ON state) row by row at a predetermined timing. All the remaining second ejection electrodes 38 are driven at the ground level (the ground state, i.e., in an OFF state). On the other hand, the first ejection electrodes 36 are simultaneously driven on a column basis at a high voltage level or at the ground level in accordance with image data. As a result, the ejection/non-ejection of the ink in each of the ejection portions is controlled.

That is, when the second ejection electrode 38 is at the high voltage level or in the high impedance state, and the first ejection electrode 36 is at a high voltage level, the ink Q is ejected in the form of the ink droplet R. When the first ejection electrode 36 or the second ejection electrodes 36 or both are at the ground level, no ink is ejected.

Then, the ink droplets R ejected from the respective ejection portions are attracted to the recording medium P charged to a negative high voltage and adhere to the recording medium P at predetermined positions to form an image.

Under these circumstances, the drive frequency for the control electrode for ejection of the ink droplet R becomes a drive frequency for the first ejection electrode 36.

As described above, when the rows of the second ejection electrodes 38 as the lower layer are sequentially turned ON, and the first ejection electrodes 36 as the upper layer are turned ON/OFF in accordance with image data, the first ejection electrodes 36 are driven in accordance with the image data. Thus, when the individual ejection portions in the column direction are supposed to be the centers, in the ejection portions on both the sides of each central ejection portion, the levels of the first ejection electrodes 36 are changed frequently to the high voltage level or to the ground level. In this case, the guard electrode 40 is biased at a predetermined guard potential, e.g., at the ground level in recording an image, thereby excluding influences of electric fields of the adjacent ejection portions.

In addition, in the head 12 in the illustrated example, as another embodiment, the first and second ejection electrodes 36 and 38 can also be driven in opposite states. That is, the first ejection electrodes 36 can be sequentially driven column by column, and the second ejection electrodes 38 can be driven in accordance with the image data.

In this case, with respect to the column direction, the first ejection electrodes 36 are driven column by column, and when the individual ejection portions in the column direction are supposed to be the centers, the first ejection electrodes 36 of the ejection portions on both the sides of each central ejection portion in the column direction usually are at the ground level. Thus, the first ejection electrodes 36 of the ejection portions on both the sides of each central ejection portion in the column direction function as the guard electrode 40. In the case where the first ejection electrodes 36 as the upper layer are sequentially turned ON column by column, and the second ejection electrodes 38 as the lower layer are driven in accordance with the image data, even if no guard electrode 40 is provided, the influences of the adjacent ejection portions can be excluded to enhance the recording quality.

In the head 12, whether the control for the ejection/non-ejection of the ink is carried out using one or both of the first ejection electrodes 36 and the second ejection electrodes 38 is not a limiting factor at all. That is, the voltages of the control electrode side and the recording medium P side only have to be suitably set so that when a difference between the voltage value on the control electrode side during the ejection/non-ejection of the ink and the voltage value on the recording medium P side is larger than a predetermined value, the ink is ejected, while when the difference is smaller than the predetermined value, no ink is ejected.

In addition, while in this embodiment, the colorant particles in the ink are positively charged, and the recording medium P side is charged to a negative high voltage, the present invention is not limited thereto. That is, conversely, the colorant particles in the ink may be negatively charged, and the recording medium P side may be charged to a positive high voltage. When the polarity of the colorant particles is thus reversed to that of the colorant particles in the above-mentioned embodiment, the polarities of the voltages applied to the charging unit 16 for the recording medium P, and the first and second ejection electrodes 36 and 38 of each of the ejection portions only have to be reversed to those in the above-mentioned embodiment.

An electrostatic ink jet recording method of the present invention will hereinafter be described in detail by making mention of the operation for ejection of the ink droplet R in the recording apparatus 10.

Note that in the following example, the colorant particles dispersed in the ink Q are charged positive, and hence the positive voltages are applied to the corresponding ones of the first ejection electrodes 36 and the corresponding ones of the second ejection electrodes 38, respectively, and also the recording medium P is charged to a negative bias voltage in order to eject the ink droplet R.

In recording an image, the ink Q is circulated through the ink flow path 26 from the right-hand side to the left-hand side in FIG. 1B (in a direction indicated by an arrow a in FIG. 1B) at a predetermined speed by a circulation mechanism for ink (not shown).

On the other hand, the recording medium P is charged to a negative high voltage (e.g., at −1,500 V) by the charging unit 16, and is transported to the back side of the paper in FIGS. 1A and 1B at a predetermined speed by transport means (not shown) while being electrostatically attracted to the insulating sheet 62 of the holding means 14.

Figure 3A:
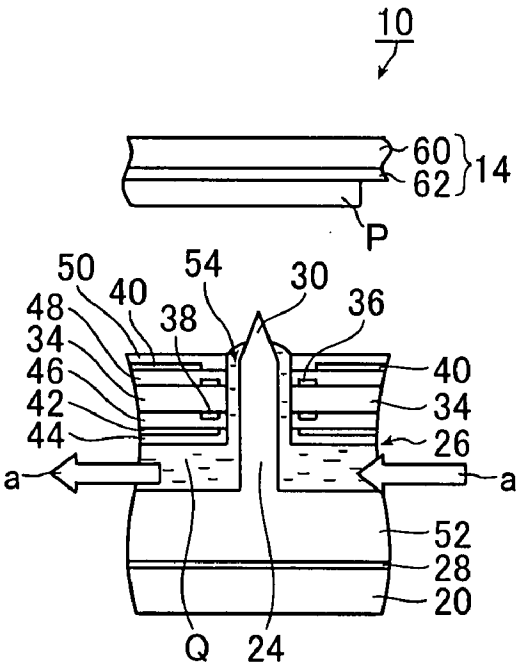
FIGS. 3A to 3C are conceptual views illustrating the ink jet recording method of the present invention.

In the state in which only the bias voltage is applied to the recording medium P, the Coulomb attraction between the bias voltage and the electric charges of the colorant particles of the ink Q, the Coulomb repulsion among the colorant particles, the viscosity of the carrier liquid, the surface tension, the dielectric polarization force and the like act on the ink Q, and these factors operate in conjunction with one another to move the colorant particles and the carrier liquid. Thus, the balance is kept in a meniscus shape as conceptually shown in FIG. 3A in which the ink Q slightly rises from the ejection port 54.

In addition, the Coulomb attraction and the like allow the colorant particles to move toward the recording medium P charged to the bias voltage through a so-called electrophoresis process. That is, the ink Q is concentrated at the meniscus in the ejection port 54.

Under this state, pulse voltages used to eject the ink droplet R are applied (ejection is valid). That is, in the illustrated example, the pulse voltages each falling within a range of about 100 to 600 V are applied from the corresponding pulse power supplies to the first and second ejection electrodes 36 and 38, respectively and the electrodes are driven to perform ejection.

Figure 3B:
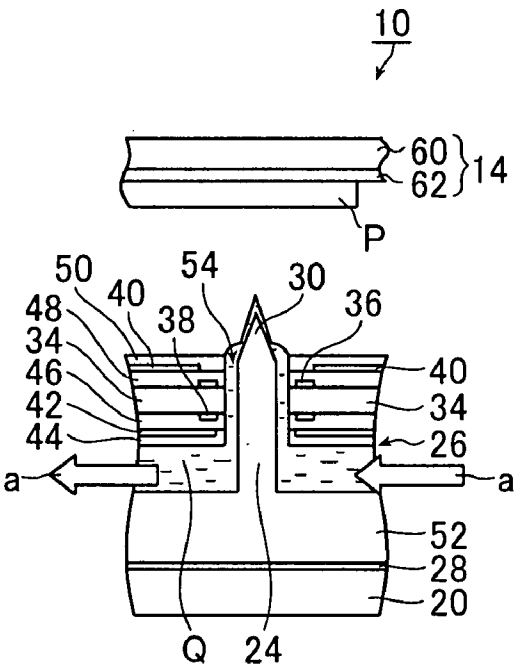

As a result, the pulse voltage is superposed on the bias voltage, and hence the motion occurs in which the previous conjunction motion operates in conjunction with the superposition of the pulse voltage. Thus, the colorant particles and the carrier liquid are attracted toward the bias voltage side (the counter electrode side), i.e., the recording medium P side through the electrophoresis process. As a result, as conceptually shown in FIG. 3B, the meniscus grows to form a nearly conical ink liquid column, i.e., the so-called Taylor cone from the tip portion of the meniscus. In addition, similarly to the foregoing, the colorant particles are moved to the meniscus surface through the electrophoresis process so that the ink Q at the meniscus is concentrated and has a large number of colorant particles at a nearly uniform high concentration.

Figure 3C:
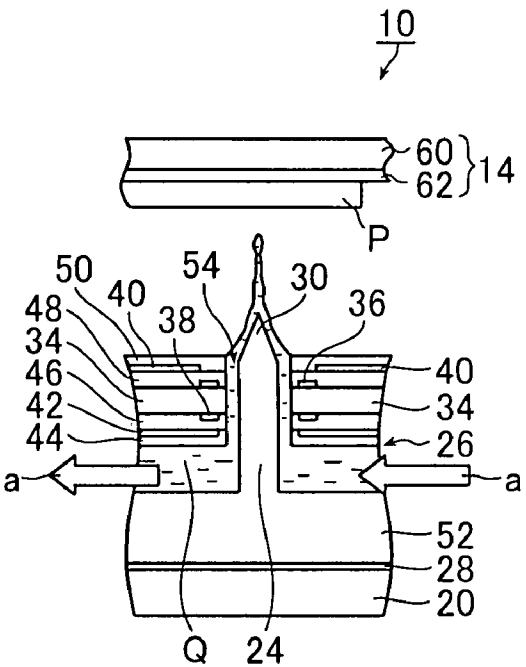
Figure 4:
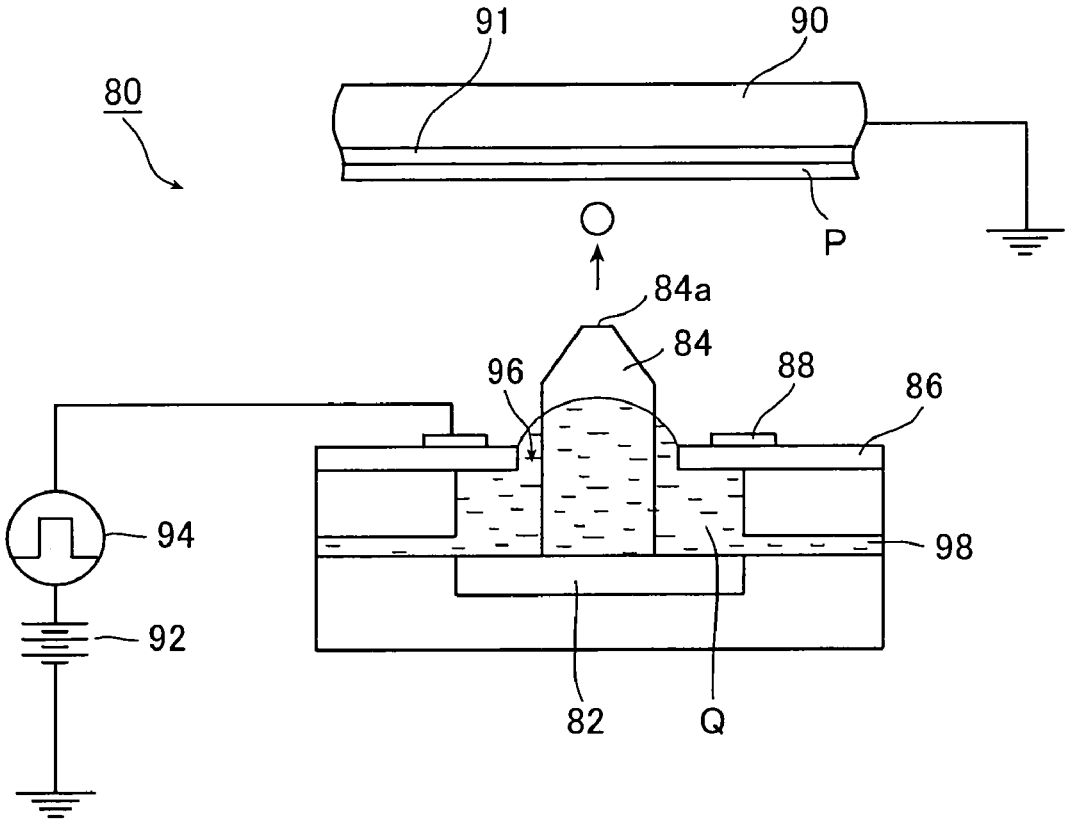
FIG. 4 PRIOR ART
FIG. 4 is a conceptual view illustrating a conventional electrostatic ink jet recording process.

When a finite period of time further elapses after the start of the application of the pulse voltage, the balance mainly between the Coulomb attraction acting on the colorant particles and the surface tension of the carrier liquid is broken at the tip portion of the meniscus having the high electric field strength applied thereto due to the movement of the colorant particles or the like. As a result, the meniscus abruptly grows to form a slender ink liquid column, called the thread, as conceptually shown in FIG. 3C.

When a finite period of time further elapses, the thread is divided into small portions due to the interaction resulting from the growth of the thread, the vibrations generated due to the Rayleigh/Weber instability, the ununiformity in distribution of the colorant particles within the meniscus, the ununiformity in distribution of the electrostatic field applied to the meniscus, and the like. The divided thread is then ejected and flown in the form of the ink droplets R and is attracted by the bias voltage as well to adhere to the recording medium P.

The growth of the thread and its division, and moreover the movement of the colorant particles to the meniscus and/or the thread are continuously generated while the pulse voltages are applied to the first and second ejection electrodes, respectively. In other words, during the formation of the thread, the ink droplets R intermittently fly toward the recording medium P. In addition, at the end of the application of the pulse voltages to the first and second ejection electrodes (ejection is invalid), there is no sufficient force to attract the colorant particles and the carrier liquid to the recording medium P side and the thread formed gets smaller. When a predetermined period of time elapses, the ink Q returns to the state of the meniscus shown in FIG. 3A in which only the bias voltage is applied to the recording medium P.

As is clear from the above, when a pulse voltage (drive voltage) is applied in the electrostatic ink jet recording, a thread is formed and then divided into small portions. Thus, multiple fine ink droplets are ejected and adhere to the recording medium P to form an image of one dot on the recording medium P.

With the ink jet recording method according to the present invention, when the relative speed is referred to as "v", the division frequency of the thread is referred to as "f", and the diameter of the thread is referred to as "d", Expression 1 given below is satisfied.

$$(v/f)<(a\times d) \qquad \text{Expression 1}$$

Here, "a" in Expression 1 is a coefficient determined as appropriate by the density, flying droplet diameter, flying speed, surface tension, viscosity, and the like of the ink, for instance. Also, the density, flying droplet diameter, flying speed, surface tension, viscosity, and the like of the ink change in accordance with temperature or the like, for instance.

The relative moving speed v refers to a speed at which the recording medium P and the ink jet head 12 move relatively at the time of recording. More specifically, in this embodiment, the ink jet head 12 is fixed and the recording medium P is transported as described above, so the relative moving speed refers to the transport speed of the recording medium P (moving speed of the insulating sheet 62). In the case of a serial head, however, a recording medium is fixed and a head is scanned at the time of recording, so the relative moving speed refers to the scanning speed of the head.

Also, the diameter d of the thread refers to the midpoint diameter of the thread, that is, the diameter of the midpoint between the tip end of the thread and a portion that was the tip end portion of a Taylor cone.

Here, it is preferable that the diameter of the thread satisfies Expression 1 at all times while the division of the thread is being performed.

As described above, in the electrostatic ink jet recording, multiple ink droplets are ejected through application of a drive voltage for one pulse and one dot is formed by the multiple ink droplets on the recording medium P. In order to form one dot with multiple ink droplets in this manner, it is required to eject the ink droplets onto the recording medium P in an overlapping manner. However, the ejected ink droplets are very minute, so there is a case where the landing positions are not stabilized, the ink droplets do not land on the recording medium P in an overlapping manner, and one image dot is not suitably formed. In this case, image quality is lowered.

With the ink jet recording method according to the present invention, however, by ejecting ink droplets under a condition where Expression 1 given above is satisfied, the landing positions of the ejected ink droplets are stabilized.

As a result, it becomes possible to cause the ink droplets to land on the recording medium P in a suitably overlapping manner, which makes it possible to form an intended image dot by suitably forming one image dot with multiple ink droplets. With the ink jet recording method according to the present invention, it becomes possible to form an intended image dot as described above, so a high-resolution and high-quality image can be recorded.

Also, by forming one image dot with multiple fine ink droplets, solvent evaporation is promoted during flying, which makes it possible to prevent bleeding on the recording medium P.

Here, it is preferable that with the ink jet recording method according to the present invention, "a" in Expression 1 be set in a range of 1.1 to 15.

Also, it is preferable in terms of image quality that with the ink jet recording method according to the present invention, dots overlap each other on the recording medium in half. Here, the time interval between the landing of the dots is "1/f", so a distance by which the ink jet head and the recording medium move relatively between the landing of the dots, is "v/f". Accordingly, when the dot diameter of the droplets on the recording medium is referred to as "D", the following expression is obtained.

$$D/2>v\times(1/f)$$

Here, the dot diameter D of the droplets on the recording medium is significantly influenced by the diameter d' of the ink droplets immediately before the landing. The diameter d of the thread formed, the division frequency f of the thread, and the growing speed of the thread can assume various values. However, according to results of studies conducted by the inventors of the present invention, with consideration given to general ranges, it is considered that the diameter d' of the ink droplets immediately before the landing is in a range of 2d to 10d and it is also considered that the dot diameter D of the droplets on the recording medium is in a range of 1.1d' to 3d'.

From the expression and numerical values given above, the following expression is obtained.

$$V/f<(1.1 \text{ to } 15)d$$

Accordingly, by setting the coefficient "a" in Expression 1 in the range of 1.1 to 15, the effects described above are provided more suitably and higher-quality drawing becomes possible.

In addition, also by satisfying one of a condition that the diameter d of the thread formed is 10 μm or less and a condition that the diameter of the ink droplets ejected is 20 μm or less or, more preferably, the volume of the ink droplets is 2 pl or less, the effects described above are provided more suitably and higher-quality drawing becomes possible.

Further, it is preferable that the division frequency f is set higher than the image recording frequency and it is more preferable that the division frequency f is set 10 or more times as high as the image recording frequency. Here, the image recording frequency refers to a drive frequency, that is, the application frequency of a drive voltage for one pulse.

When the division frequency f is set higher than the image recording frequency, in addition to the effects described above, the ejection of the ink droplets is stabilized, so it becomes possible to form a higher-quality image. Also, when the division frequency f is set 10 or more times as high as the image recording frequency, it becomes possible to provide more profound effects.

It is preferable that with the ink jet recording method according to the present invention, one dot is formed with multiple ink droplets by ejecting the ink droplets so as to land on the recording medium P in an overlapping manner and then fixing the ink droplets onto the recording medium P.

By causing multiple ink droplets to land on the recording medium P in an overlapping manner and then fixing the ink droplets onto the recording medium P in this manner, it becomes possible to more suitably form one image dot by means of a uniting and shaping effect by surface tension of the ink droplets landed earlier and later on the recording medium P. Here, the fixation of the ink droplets refers to evaporation of the dispersion medium of the ink droplets or absorption of the dispersion medium of the ink droplets into the recording medium, for instance.

Also, it is preferable that the number of ink droplets forming one dot be controlled in accordance with an image to be recorded.

By controlling the number of ejected ink droplets in accordance with the size, density, and the like of an intended image dot in this manner, it becomes possible to further improve the gradation resolving power, which makes it possible to form a higher-resolution and higher-quality image.

Further, it is preferable that one image dot is formed by causing five or more ink droplets to land on the recording medium P in an overlapping manner.

By forming one image dot with five or more ink droplets, it becomes possible to reproduce a shape closer to a circular shape.

Here, the relative scanning speed v, the division frequency f of the thread, and the diameter d of the thread used with the ink jet recording method according to the present invention are influenced by various conditions, so it is possible to implement the present invention by selecting/controlling them as appropriate.

More specifically, as an example of the scanning speed v, it is possible to cite the transport speed of the recording medium in the case of a line head and to cite the scanning speed of the head in the case of a serial head.

Also, the diameter d of the thread formed is influenced by the viscosity of the ink, the electric conductivity of the ink, the surface tension of the ink, the charge amount of the ink, the drive voltage applied to the ejection electrodes, and the like, so the diameter d of the thread formed can be controlled by adjusting at least one of them.

Further, the division frequency f of the thread is influenced by the viscosity of the ink, the electric conductivity of the ink, the surface tension of the ink, the charge amount of the ink, the drive voltage applied to the ejection electrodes, the bias voltage applied to the recording medium, and the like, so the division frequency f of the thread can be controlled by adjusting at least one of them.

It is possible to implement the ink jet recording method according to the present invention by selecting/controlling the relative scanning speed v, the division frequency f of the thread, and the diameter d of the thread as appropriate.

For instance, when "a" is set in the range of 1.1 to 15 that is the suitable value range described above, the diameter d of the thread formed is set at 2 μm, and the division frequency f of the thread is set at 200 kHz, Expression 1 given above is changed as follows.

$$V/f<a\times d$$

$$V/(200\times10^{3})<(1.1 \text{ to } 15)\times(2\times10^{-6})$$

$$V<(1.1 \text{ to } 15)\times(2\times10^{-6})\times(200\times10^{3})$$

$$V<(4.4 \text{ to } 60)\ 10^{-1}\approx0.5 \text{ to } 6$$

By controlling the relative scanning speed v so as to become 0.5 to 6 m/s obtained above or less in accordance with the value of "a", it is possible to realize the ink jet recording method according to the present invention.

It should be noted here that in the example described above, Expression 1 is satisfied by controlling the relative scanning speed v, but it is of course possible to satisfy Expression 1 by controlling the diameter d of the thread formed or the division frequency f of the thread.

In addition, it is preferable that when the landing diameter of the ink droplets on the recording medium is referred to as "D", the relative moving speed is referred to as "v", and the division frequency of the thread is referred to as "f", Expression 2 given below is satisfied.

$$(v/f)<D \qquad \text{Expression 2}$$

By performing image recording under a condition where Expression 2 given above is satisfied, it becomes possible to cause the ink droplets to land on the recording medium P in a more suitably overlapping manner, which makes it possible to suitably form one image dot with multiple ink droplets and to more suitably form an intended image dot. As described above, it is possible to more suitably form an intended image dot, so a high-resolution and high-quality image can be recorded.

The ink jet recording method of the present invention may be used for recording a color image or a monochrome image as long as the above conditions are met.

It is preferable to implement the present invention for all the colors when a color image is recorded. However, this is not the sole case of the invention and the ink jet recording method of the present invention may be implemented only for one color.

While the ink jet recording method of the present invention has been described above in detail, it is to be understood that the present invention is not limited to the above-mentioned embodiment. Hence various improvements and changes may be made without departing from the gist of the present invention.

What is claimed is:

1. An ink jet recording method in which ink jet recording of an image on a recording medium is performed in an ink jet head, comprising:

allowing an electrostatic force to act on ink prepared by dispersing charged particles containing colorants in a dispersion medium to form a thread of said ink;

dividing said thread into ink droplets of said ink to eject said ink droplets toward said recording medium; and allowing said ink droplets to be landed onto said recording medium moving relatively to said ink jet head to form an image dot on said recording medium, wherein, when a speed at which said recording medium and an ejection portion of said ink jet head for ejecting said ink droplets move relatively is referred to as "v", a division frequency of said thread is referred to as "f", and a diameter of said thread is referred to as "d", the following expression is satisfied:

$$(v/f)<(a\times d)$$

where "a" is a coefficient determined by a density, a surface tension and a viscosity of said ink, as well as a flying droplet diameter and a flying speed of each of said ink droplets of said ink.

2. The ink jet recording method according to claim 1, said coefficient "a" is in a range of 1.1 to 15.

3. The inkjet recording method according to claim 1, wherein at least one of a condition that said diameter of said thread is 10 μm or less and a condition that a diameter of each of said ejected ink droplets is 20 μm or less is satisfied.

4. The inkjet recording method according to claim 1, wherein a division frequency of said thread is higher than an image recording frequency controlling ejection of said ink droplets.

5. The inkjet recording method according to claim 4, wherein said division frequency of said thread is 10 or more times as high as said image recording frequency controlling said ejection of said ink droplets.

6. The inkjet recording method according to claim 1, wherein one image dot is formed by ejecting, before fixing a previous ink droplet landed on said recording medium, the following ink droplet so as to be landed on said recording medium in an overlapping manner.

7. The inkjet recording method according to claim 1, wherein the number of ink droplets forming one image dot is controlled in accordance with said image to be recorded.

8. The inkjet recording method according to claim 7, wherein one image dot is formed by causing five or more ink droplets to be landed on said recording medium in an overlapping manner.

* * * * *